US009714477B2

(12) United States Patent
Nägeli et al.

(10) Patent No.: US 9,714,477 B2
(45) Date of Patent: Jul. 25, 2017

(54) FASTENING SYSTEM FOR A COMPACTION MODULE ON A SPINNING MACHINE

(71) Applicant: Maschinenfabrik Rieter AG, Winterthur (CH)

(72) Inventors: Robert Nägeli, Kleinandelfingen (CH); Ludek Malina, Kloten (CH); Gabriel Schneider, Winterthur (CH)

(73) Assignee: Maschinenfabrik Rieter AG, Winterhur (CH)

( * ) Notice: Subject to any disclaimer, the term of this patent is extended or adjusted under 35 U.S.C. 154(b) by 286 days.

(21) Appl. No.: 14/402,938

(22) PCT Filed: May 17, 2013

(86) PCT No.: PCT/IB2013/000970

§ 371 (c)(1),
(2) Date: Nov. 21, 2014

(87) PCT Pub. No.: WO2013/175282

PCT Pub. Date: Nov. 28, 2013

(65) Prior Publication Data

US 2015/0167204 A1 Jun. 18, 2015

(30) Foreign Application Priority Data

May 21, 2012 (CH) ..... 0709/12

(51) Int. Cl.
*D01H 5/72* (2006.01)
*D01H 5/66* (2006.01)

(52) U.S. Cl.
CPC ..... *D01H 5/72* (2013.01); *D01H 5/66* (2013.01)

(58) Field of Classification Search
CPC ..... D01H 5/72
See application file for complete search history.

(56) References Cited

U.S. PATENT DOCUMENTS 2,849,852 A 9/1958 Jacobi et al.
2,956,389 A * 10/1960 Berberich ..... D01H 5/68 19/263

(Continued)

FOREIGN PATENT DOCUMENTS

CH 699 713 A2 4/2010
CN 201695124 U 1/2011

(Continued)

OTHER PUBLICATIONS

Swiss Patent Office Search Report, Jun. 27, 2012.
PCT Search Report, Sep. 9, 2013.

*Primary Examiner* — Shaun R Hurley
(74) *Attorney, Agent, or Firm* — Dority & Manning, P.A.

(57) ABSTRACT

A fastening mechanism is provided to detachably fasten and position a compaction module on a drafting unit of a spinning machine, wherein the compaction module has a carrier, which is provided with at least one suction channel that is connected to suction inserts of compaction elements that are movably mounted on the carrier. A coupling device using the fastening mechanism. In order to ensure simple and positionally accurate attachment of a compaction module, the fastening mechanism is composed of at least one clamping element that has retaining elements for fixed and positioned fastening on the spinning machine and is provided with a first receiving slot, which is open on one side and has a retaining section, by means of which a retaining element fastened on the carrier can form a positive-fitting clamped connection.

14 Claims, 3 Drawing Sheets

(56) References Cited

U.S. PATENT DOCUMENTS

| | | | | |
|---|---|---|---|---|
| 3,387,339 | A * | 6/1968 | Bofill | D01H 5/72 19/150 |
| 4,011,997 | A | 3/1977 | Klimas | |
| 4,845,938 | A | 7/1989 | Halder et al. | |
| 5,953,792 | A | 9/1999 | Strobel et al. | |

FOREIGN PATENT DOCUMENTS

| | | |
|---|---|---|
| DE | 1 067 714 | 10/1959 |
| DE | 78 12 638 | 8/1978 |
| DE | 101 45 444 A1 | 4/2003 |
| FR | 1 051 929 | 1/1954 |
| JP | H-8-260259 | 10/1996 |

* cited by examiner

FASTENING SYSTEM FOR A COMPACTION MODULE ON A SPINNING MACHINE

FIELD OF THE INVENTION

The invention relates to a fastening system for detachably fastening and positioning a compaction module on a drafting unit of a spinning machine, wherein the compaction module has a carrier, which is provided with at least one suction channel, which is connected to suction inserts of compaction elements that are movably mounted on the carrier.

The invention further relates to a coupling device, which comprises the fastening system configured according to the invention, for connecting a suction channel, which is integrated in the carrier of the compaction module, to a suction tube, which is connected to a central suction channel.

BACKGROUND

Document PCT/CH2011/000280, which was not previously published, illustrates and describes an embodiment of a detachably installed compaction module for the fiber material that is output by a drafting unit (e.g., a twin drafting system) of a spinning machine (e.g., a ring spinning machine). In this case, the compaction module comprises a carrier on which rotatably mounted suction drums are attached. Suction inserts are provided inside the suction drums and are connected to a suction channel, which is installed inside the carrier. At the free of the carrier, at which the suction channel also terminates, the carrier is provided with a U-shaped end piece via which the carrier is slid onto a suction tube. In so doing, the outlet opening of the suction channel comes into overlap with an opening in the suction tube, thereby establishing a connection between the suction inserts and a vacuum source, which is connected to the suction tube. The dimensions of the U-shaped end piece of the carrier and of the outer diameter of the suction tube are selected such that the carrier is held on the suction tube by means of the clamping effect between the end piece and the suction tube, and a pivot movement of the carrier and therefore of the compaction module in the circumferential direction of the suction tube is made possible. By means of this pivot movement, the compaction module is pivoted from a working position into an idle position and, conversely, from an operating position into an idle position.

The disadvantage of the known embodiment is that an additional extraction tube must be installed. A further difficulty is that of quickly and exactly positioning the carrier on the suction tube in order to ensure that the opening of the suction channel comes into alignment with the corresponding opening on the suction tube. Additional guides may need to be installed on the suction tube for this purpose. Special sealing elements need to be installed in order to sufficiently seal off the suction channel and the inner region of the suction tube in the region of the coupling point from the surroundings.

SUMMARY OF THE INVENTION

It is an object of the invention to eliminate the disadvantages of known solutions and to provide fastening means for installing an additional compaction module on drafting systems of spinning machines via which the respective compaction module can be installed and removed quickly and easily and in an exact position relative to the drafting unit. Likewise, a coupling device for connecting a central suction channel of the spinning machine to the suction inserts of the compaction module using a fastening mechanism designed according to the invention is proposed, by means of which the compaction module can be easily installed on pre-existing drafting units of spinning machines without special and additional suction tubes having special sealing elements.

Additional objects and advantages of the invention will be set forth in part in the following description, or may be obvious from the description, or may be learned through practice of the invention.

The objects are achieved on the one hand by virtue of the fact that the fastening mechanism is composed of at least one clamping element, which has retaining elements that ensure fixed and positioned fastening on the spinning machine, and which is provided with a first receiving slot, which is open on one side and has a retaining section, by means of which a retaining element that is fastened on the carrier can form a positive-fitting clamped connection.

The fastening mechanism, i.e., the clamping element, is fastened on the spinning machine in a defined and predetermined position by means of the proposed retaining member and is therefore aligned exactly with the position of the respective drafting unit.

Via the further proposed receiving slot, which is open on one side, the carrier can be easily and quickly moved, via a retaining element that is fastened on the carrier, into a fixed position in which the retaining element assumes a positive-fitting clamped connection with a retaining section in the region of the receiving slot.

The term "receiving slot" is intended to mean, for example, a narrow opening that extends in the longitudinal direction (e.g., an elongated hole) which is open on one side for the insertion of a retaining element (e.g., a pin or a bolt). In order to support the insertion, this opening can be formed to diverge in the insertion region. In this case, the retaining section can have a greater inner diameter than the receiving slot, and therefore the retaining element that is inserted into the receiving slot is locked and fixed in the retaining section by means of elastic deflection of at least one of the elements of the clamping element that form the slot. In order to obtain this effect, the outer dimension of the retaining element approximately corresponds to the inner diameter of the retaining section and is greater than the smallest inner diameter of the slot in the region between the opening of the slot and the retaining section.

The mentioned clamping element is preferably made of a plastic (e.g., a plastic injection-molded part) in order to permit elastic deflection of the clamping element in the region of the receiving slot.

It is further provided that the fastening mechanism is formed by two clamping elements, which are fastened spaced apart from one another on the spinning machine.

The two clamping elements thereby support the carrier on two sides by means of one retaining element in each case, said retaining element being held in the retaining section of the respective clamping element.

The two clamping elements can have the same shape.

It is also conceivable to connect the two clamping elements to one another via webs.

Moreover, it is provided that the positive-fitting connection between the retaining section and the respective retaining element of the carrier allows a pivot movement of the carrier in a pivot plane that extends parallel to the plane of the first receiving slot, wherein the respective clamping element comprises stops for limiting this pivot movement.

The shape of the retaining section is matched to the shape of the retaining element in order to allow the compaction module to pivot. Preferably, the retaining element is composed of a round bolt, whereas the retaining section has a circular cross-section. As a result, the retaining elements (e.g., a bolt) can rotate in the locking position in the retaining section in order to allow the carrier of the compaction module to pivot. In order to limit this pivot movement so as to hold the compaction module in a certain idle position, stops are provided on the clamping elements, against which the carrier rests when the pivot movement occurs. In the operating position, the carrier is held via an appropriately formed locking device, which is described in more detail in the exemplary embodiments that follow.

In order to form a coupling point for the connection of a suction tube that is connected to a vacuum source, it is further proposed that the respective clamping element is provided with a second receiving slot that is open on one side and has a retaining section, which can form a positive-fitting connection to a retaining element of a tube element, which is connected to the suction tube.

Therefore, it is possible to assign an additional function to the clamping element, namely, in addition to the function of fastening the compaction module to the spinning machine, that of functioning as a coupling point with a suction tube that establishes the connection of the suction channel to a vacuum source. In this case, it must be ensured that the connection between the suction channel remains sealed off from the surroundings even when the compaction module pivots.

Preferably, it is provided that the longitudinal axes of the first and second receiving slots intersect at an angle. Thus, installation and removal of the compaction module and the tube element of the suction tube can be carried out without any problems. The longitudinal axes, which extend in the longitudinal plane of the respective receiving slot, can intersect at an angle, for example between 60° and 120°.

In order to ensure that the tube element for the connection to the suction tube remains within a predetermined position range on the clamping element, the respective clamping element has—as seen in the extension of the second receiving slot—a pocket-shaped receptacle that is open on one side and is provided for fixing a web that is fastened on the tube element. The positioning of the tube element relative to the clamping element and therefore relative to the suction channel of the carrier of the compaction module is thereby ensured.

In order to easily and quickly install the clamping elements on the spinning machine, it is proposed that the retaining means of the respective clamping element is formed by a U-shaped base section that is installed below the first receiving slot. Moreover, it is proposed that the limbs of the U-shaped base section are each provided with an opening for receiving a fixing element.

It is therefore possible to install the fastening mechanism or the clamping elements on a carrier element (e.g., a shaft) mounted on the spinning machine in a simple, quick, and positionally accurate manner, for example.

In order to obtain a simple and functionally reliable coupling device, comprising the fastening mechanism or the clamping elements proposed according to the invention, for connecting a suction channel that is integrated in the carrier of the compaction module, to a suction tube that is connected to a central suction channel, it is proposed that an end ring is installed on the end of the suction channel that is located in the region of the fastening mechanism, the end ring projecting over the suction channel in the longitudinal direction and being provided with an annular outer surface that extends conically inward and is directed away from the suction channel, and on which a conically outwardly extending annular inner surface of a tubular element rests, at least in part, the tube element held in the respective retaining section of the second receiving slot by two clamping elements that are fastened spaced apart from one another on the spinning machine, and that the suction tube sealingly rests with its inner surface on the outer circumference of the free end of the tube element. In this case, the conically extending annular outer surface of the end ring—as seen in the axial direction—can have a surface that is slightly outwardly curved (convex) in order to allow slight movement between the described outer surface of the end ring and the conically extending inner surface of the tube element. This movement occurs during the pivoting of the compaction module in a predefined region.

By means of the proposed coupling device, the compaction module can be easily retrofitted onto existing drafting units without the use of additional extraction channels. Since the extraction tubes for extracting fibers are typically connected to the suction channel of the compaction module, existing couplings can be used to connect the suction channel to a central extraction channel. That is, in a conventional spinning machine without a compaction module, the coupling for the fiber extraction device, once this fiber extraction device has been removed, can be used directly for the connection of the retrofitted compaction module in order to connect to a vacuum source.

In order to connect a flexible suction tube to the tube element in a simple and sealed manner, it is proposed that the outer circumference of the tube element on which the suction tube rests is provided with a helically extending elevation. By means of the helical elevation, it is possible to rotate the suction tube and thereby slide said suction tube onto the end piece of the tube element with relatively little force.

In order to better seal off the region of the annular surfaces of the end ring and the tube element, which lie one on top of one another and extend conically, from the surroundings, it is further proposed that an annular elastic sealing element sealingly rests on the outer circumference of the tube element that extends across the region of the conically outward extending annular inner surface, said sealing element projecting above the tube element and sealingly resting on the conically inwardly extending annular outer surface of the end ring that is located outside of the tube element.

In order to keep the vacuum conditions, and therefore the compaction of the fiber material, approximately constant at the individual compaction modules along the entire length of the spinning machine, it is proposed that different tube elements are used, which have through-openings having different inner diameters that are suitably adapted to the distance to the vacuum source. The different tube elements can have different colors in order to prevent mix-ups.

Preferably, it is further proposed that the clamping elements are fastened on a shaft that is installed in the longitudinal direction of the spinning machine. The shaft can be provided with through-openings, through which fixing elements extend, the fixing elements extending into the openings of the limbs of the U-shaped receptacle of the respective clamping element in order to fasten the clamping elements. This makes it possible to fasten the clamping elements on the available drafting units of the spinning machine in a quick and positionally accurate manner.

In order to fasten the clamping elements, it is proposed that the opening of one of the two limbs of a clamping element is provided with a thread and the fixing element is a screw, the threaded end of which extends beyond the shaft.

Naturally, there are many other possibilities for fastening the clamping elements on the spinning machine in a positionally accurate manner and with proper orientation.

BRIEF DESCRIPTION OF THE DRAWINGS

Further advantages of the invention are illustrated and described in greater detail with reference to the following exemplary embodiments, in which.

DETAILED DESCRIPTION

Figure 1:
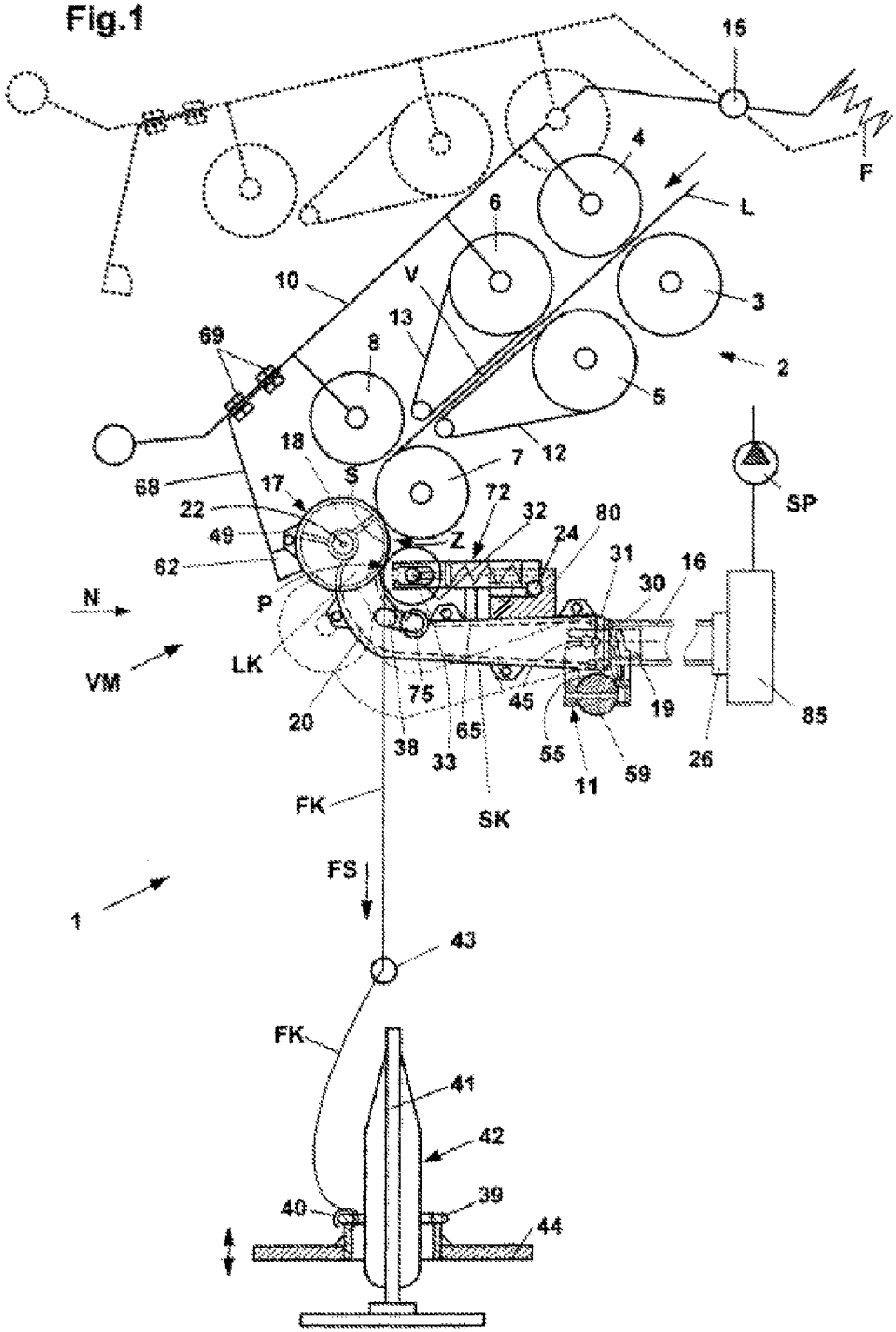
FIG. 1 shows a schematic side view of a spinning station comprising a fastening means, which is claimed according to the invention, for attaching a compaction module on a drafting unit.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic side view of a spinning station 1 of a spinning machine (ring spinning machine) comprising a drafting unit 2, which is provided with a feed roller pair 3, 4, a middle roller pair 5, 6, and a delivery roller pair 7, 8. An apron 12, 13 is wrapped around each of the middle rollers 5, 6, respectively, each apron being held in the illustrated position thereof around a cage, which is not illustrated in greater detail. The upper rollers 4, 6, 8 of the mentioned roller pairs are formed as pressure rollers, which are rotatably mounted via schematically illustrated axles on a pivotably mounted pressure arm 10. The pressure arm 10 is mounted so as to be pivotable about an axle 15 and is acted upon by a spring element F, as is schematically illustrated. This spring element can also be an air hose, for example. The rollers 4, 6, 8 are pressed against the lower rollers 3, 5 and 7 of the roller pair by means of the schematically illustrated spring load. The roller pairs 3, 5, 7 are driven via a drive, which is not illustrated. The driven lower rollers 3, 5, 7 drive the pressure rollers 4, 6, 8 and the apron 13 via friction by means of the apron 12. The circumferential speed of the driven roller 5 is slightly higher than the circumferential speed of the driven roller 3 such that the fiber material, which is fed to the drafting unit 2 in the form of a roving L, is subjected to a draft between the feed roller pair 3, 4 and the middle roller pair 5, 6. The main draft of the fiber material L takes place between the middle roller pair 5, 6 and the delivery roller pair 7, 8, wherein the delivery roller 7 has a substantially higher circumferential speed than the middle roller 5.

Figure 5:
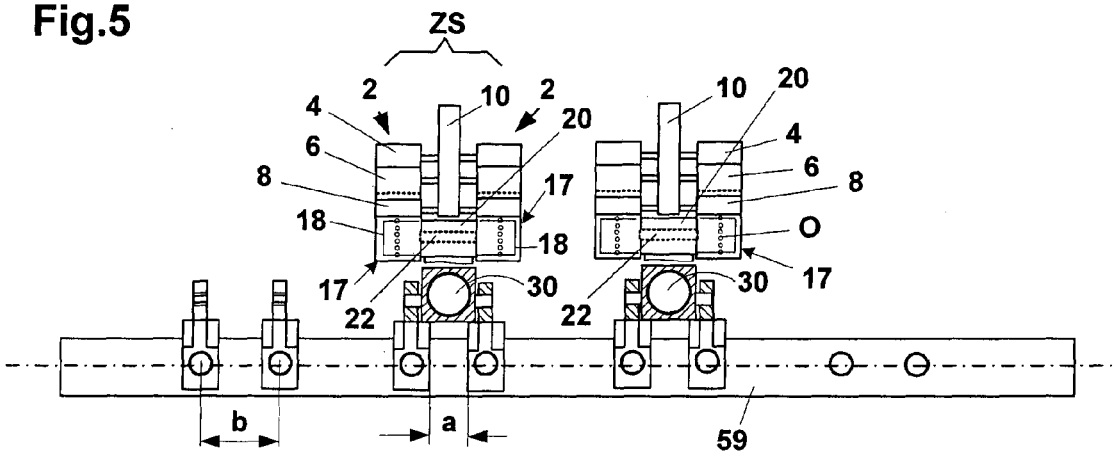
FIG. 5 shows a reduced-size view N according to FIG. 1.

As is apparent from FIG. 5 (a reduced-size view N according to FIG. 1), a common pressure arm 10 is assigned to each of two adjacent drafting units 2 (twin drafting system ZS). Since the elements of the adjacent drafting units and the compaction modules are the same, some of which are disposed in mirror-image positions, the same reference numbers are used for these parts.

The drafted fiber material V that is delivered by the respective delivery roller pair 7, 8 is redirected downward and enters the region of a suction zone Z of a downstream suction drum 17 of a compaction module VM. The respective suction drum 17 is provided with perforations or openings O, which extend around the circumference of said suction drum.

As illustrated schematically in FIG. 5, in each case two suction drums 17 are assigned to a twin drafting system ZS, said suction drums being rotatably mounted on a shaft 22, which is fastened on a carrier 20. Fixed suction inserts 18 (FIG. 5), which are connected to the carrier 20, extend into the respective suction drums 17. As illustrated schematically in FIG. 1, the suction inserts 18 are provided with air channels LK, which lead to a suction slot S that is disposed on a subregion of the circumference of the respective suction insert 18 in the region of the suction zone Z, wherein the suction slot is opposite the openings O of the suction drum 17.

Figure 4:
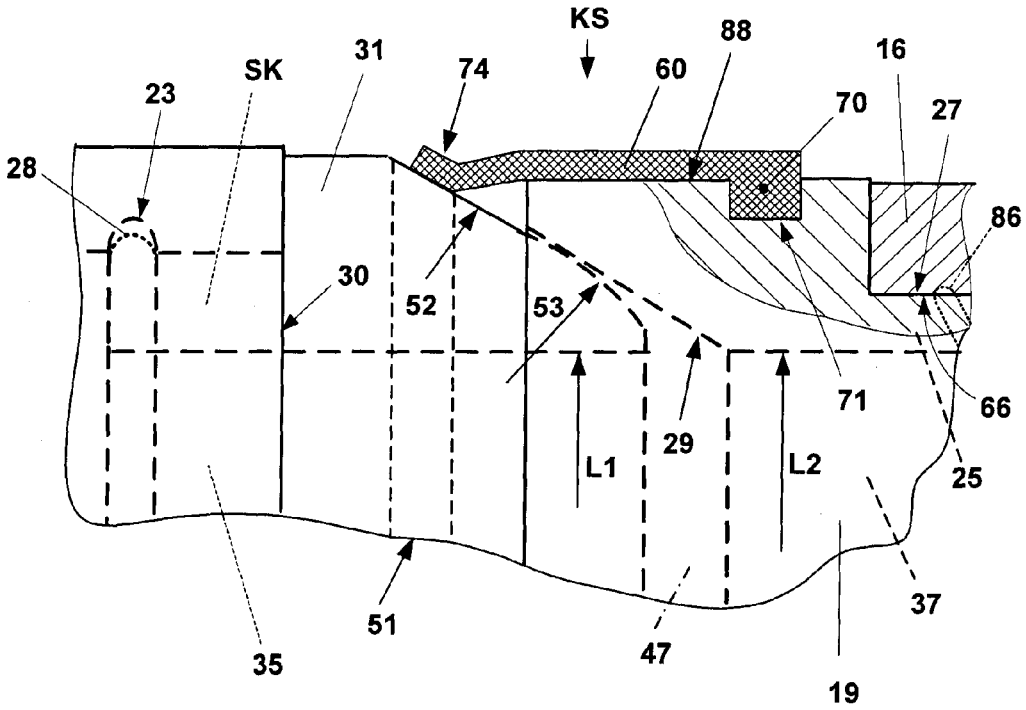
FIG. 4 shows an enlarged partial view X according to FIG. 2.

The air channels LK of the suction inserts 18 are connected to a suction channel SK, which extends within the carrier 20 to an outlet opening 30. The outlet opening 30 can have a circular shape. As shown in particular in the enlarged views of FIG. 2 and FIG. 4, in the present exemplary embodiment, a circumferential recess 23 is provided in the region of the outlet opening 30 and within the suction channel SK, into which said recess a circumferential rib 28 of an end ring 31 protrudes. The end ring 31 is held via the rib 28, in the axial and radial directions, on the carrier 20 at the outlet opening 30.

The end ring 31 has a circular through-opening 35, which has an inner diameter L1 and is disposed coaxially opposite a through-opening 37 of an attached tube element 19, wherein the through-opening 37 has an inner diameter L2.

A flexible suction tube 16, for example, is slid on the outer circumference 27 of an annular end 25 of the tube element 19, the suction tube being connected, at the other free end, to an extraction channel 85 via a schematically illustrated coupling point 26. The extraction channel 85 is connected to a vacuum source SP.

A helical elevation 86 (FIG. 2) is attached on the outer circumference 27 in order enable the suction tube 16 to be slid more easily onto the end 25 of the tube element 19 and in order to obtain a good seal between the outer circumference 27 of the end 25 and the inner surface 66 of the suction tube 16. Due to the flexibility of the suction tube, the inner surface 66 of the suction tube 16 adapts to the structure of the outer circumference 27 having the elevation 86, thereby ensuring a secure seal and, in addition, ensuring that the suction tube is securely held on the tube element.

The tube element 19, starting from the through-hole 37, is provided with a conically outwardly extending inner surface 29 of an opening 47, wherein the inner surface 29 rises (diverges) in the direction of the end ring 31. The end ring 31 is provided with an end piece 51, which protrudes in the direction of the tube element 19 and is provided with a conically extending outer surface 52, on which the inner surface 29 of the opening 47 rests, at least in part. The conically extending outer surface 52 is formed so as to slope (converge) in the direction of the tube element 19. The end of the outer surface 52 is provided with a curvature (radius) 53 in order to allow the carrier 20, with the end ring 31, to pivot relative to the tube element 19.

The carrier 20 can be composed of two half shells, for example, which are fastened against one another and, in the assembled state, form the suction channel SK. Rather than having a circular cross-section, the outlet opening 30 can also have a rectangular cross-section. In this case, the end ring 31 is also provided with a rectangularly extending rib 28 in the region of the recess 23. The through-opening 35 would also be circular in this case, as would be the outer surface 52 of the end piece 51 of the end ring 31, in order to allow the coupling with the downstream tube piece 19 in the region of the coupling point KS.

Figure 2:
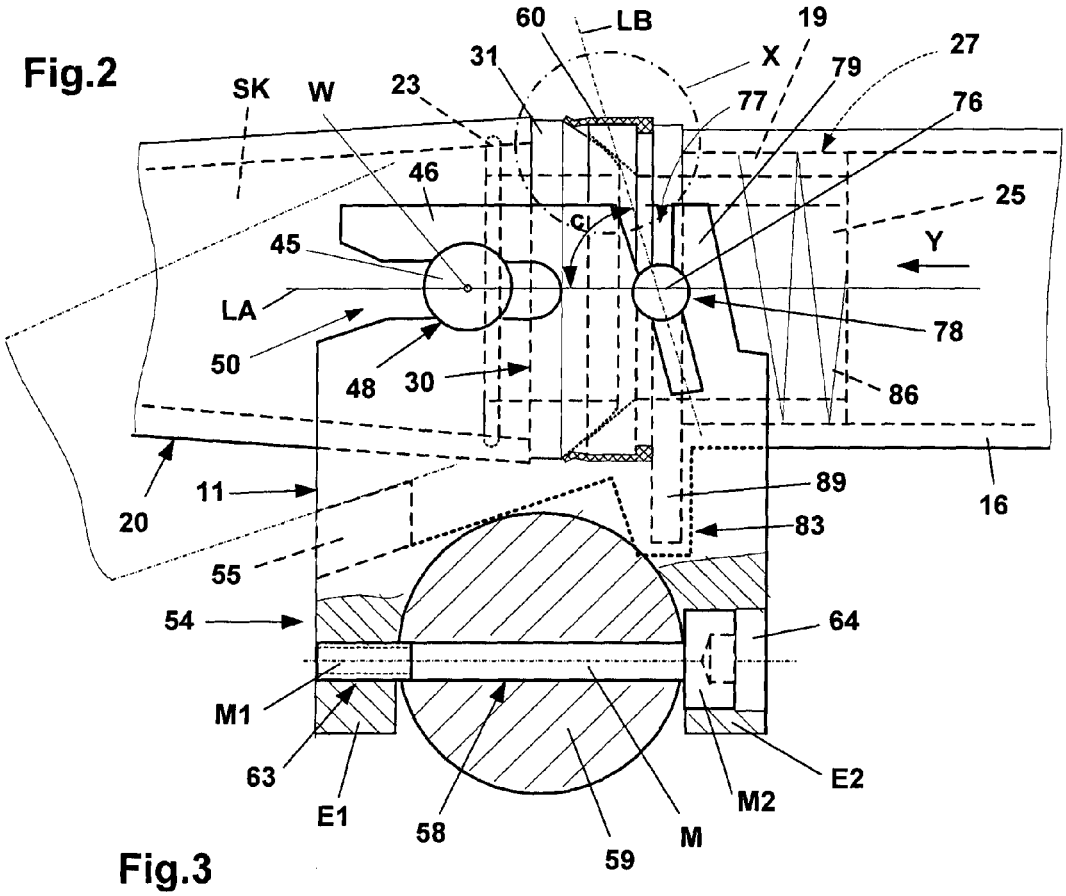
FIG. 2 shows an enlarged side view in the region of the fastening means having an appropriately formed coupling device.
Figure 3:
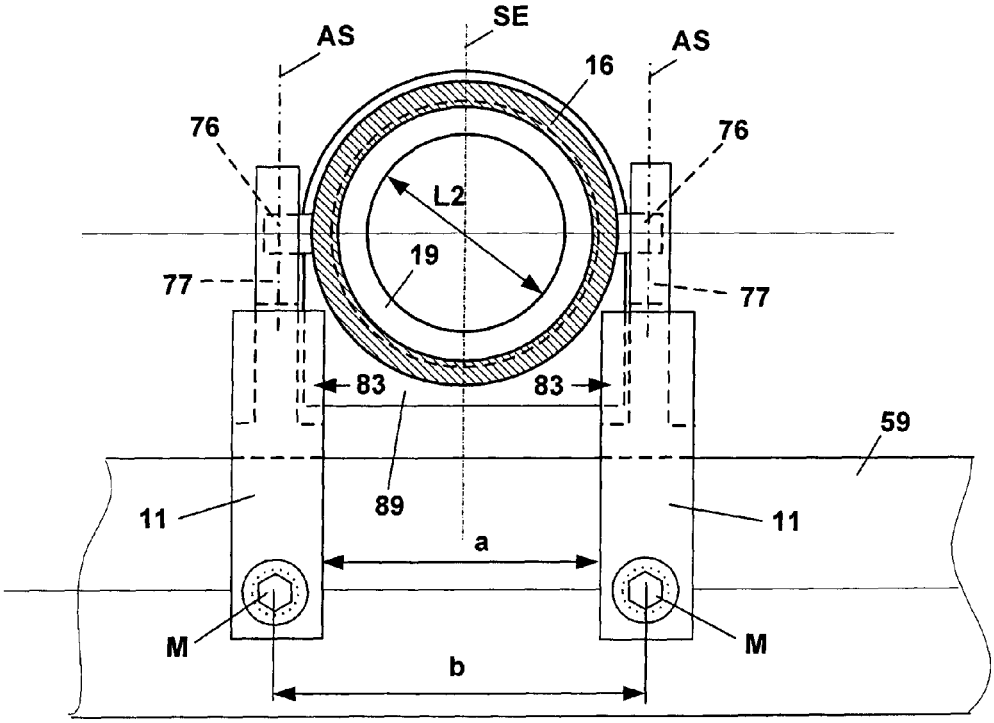
FIG. 3 shows a partial view Y according to FIG. 2.

As is apparent in particular from the enlarged view of FIG. 2 and FIG. 3, the carrier 20 of the compaction module VM is attached via two clamping elements 11, which are fastened on a shaft at a distance a. In this case, the clamping elements 11 have a U-shaped base section 54 comprising two limbs E1, E2, which U-shaped base section 54 is open on one side and via which the respective clamping element 11 is supported on a shaft 59. The shaft 59 is connected to the machine frame of the spinning machine. The shaft 59 is provided with through-openings 58, which are incorporated at an axial distance b, for positioning and fixing the respective clamping element 11 on the shaft 59 in the circumferential direction. Screws M protrude through the through-openings 58 and protrude, via the threaded section M1 thereof, into threaded bores 63 and, via the head M2 thereof, into bores 64 of the base region 54 of the respective clamping element 11.

The clamping elements 11 comprise a receiving slot 50, which is open on one side and is provided with a retaining section 48 that has a greater inner diameter than the receiving slot 50. The retaining section 48 can be circular, for example, wherein a bolt 45 is held in the retaining section by means of a clamping force. A bolt 45 is fastened on the carrier 20, on each of two opposing sides, by means of which bolts said carrier is held via the retaining sections 48 of two clamping elements 11 which are fastened on the shaft 59 at a distance a. In order to more easily insert the carrier 20 into the receiving slot 50 via the bolts 45, the receiving slot is provided with surfaces that diverge outwardly in the region of the opening. The clamping elements 11 can be composed of an elastically resilient material (e.g., plastic) in order to allow the retaining web 46 to undergo an elastic deflection when the bolt 45 is moved into the region of the retaining section 48. Due to the circular clamped connection between the retaining sections 48 and the bolts 45, the carrier 20 and, therefore, the compaction module VM are able to pivot about the central axis W of the retaining section 48.

In the operating position of the compaction module VM (FIG. 1), the suction drums 17 (or a friction ring that is connected to the suction drums) rest on the circumference of the driven delivery rollers 7, wherein the fiber material V to be compacted is located between the suction drums 17 and the delivery rollers 7, and is clamped therebetween. The compaction module VM is fixed in this position by means of a web 62, which rests on a web 49 that is fastened on the carrier 20. In order to obtain a desired contact pressing force of the suction drums 17 on the delivery roller 7, the web is attached on a leaf spring 68, which is fastened on the pressure arm 10 by means of screws 69.

After the pressure arm 10 is released and transferred into an upper position, which is illustrated by dashed lines, the compaction module VM also pivots, due to its own weight, into a lower position which is illustrated by dashed lines. This pivot movement is limited in the downward direction by a stop 65, which is attached on the respective clamping element 11. Such a position is shown by dashed lines in FIG. 2.

A nip roller 33, which forms a clamping line P with the respective suction drum 17 in the illustrated operating position, is provided subsequent to the suction zone Z, across which the suction slot S of the respective suction insert 18 also extends. The nip rollers 33 of the illustrated twin drafting system ZS are held in the operating position thereof via a dead point position and are rotatably mounted on an axle 32, which is mounted in a pressure arm 72. A spring element is installed in the pressure arm 72, via which the axle 32 is displaced and loaded, within a schematically indicated guide slot, in the direction of the respective suction drum 17. The pressure arm 72 is provided with axles 24 via which said pressure arm is pivotably fastened to a bearing element 80 on the carrier 20. By means of the pivot movement, the pressure rollers 33 can be pivoted into an idle position.

The compaction of the fiber material will not be discussed in greater detail here, since this is sufficiently known from other publications.

The clamping line P, which is produced by the clamping roller 33, simultaneously forms a so-called "twist stop gap" from which the fiber material is fed, in the form of a compacted yarn FK and while receiving a twist, in the conveyance direction FS to a schematically illustrated ring spinning device. This is provided with a ring 39 and a traveler 40, wherein the yarn is wound onto a tube 41 in order to form a bobbin 42 (cop). A thread guide 43 is disposed between the clamping line P and the traveler 40. The ring 39 is fastened on a ring frame 44, which moves up and down during the spinning process.

If thread breakage occurs between the clamping line P and the bobbin 42, the yarn FK, which is still being delivered via the clamping point P, is sucked up via the suction channel SK, via the respective extraction tube 75 that is installed on the carrier element 20, through an opening in the conveying channel 20 under the effect of a vacuum, which is generated via the vacuum source SP, and is fed to an extraction channel 85. The respective extraction opening 38 of the extraction tubes 75 is assigned to the corresponding yarn path.

An annular elastic sealing element 60 (in short: "seal") is provided for sealing off the coupling point KS between the end ring 31 and the tube element 19 from the ambient air. The seal 60 comprises a web 70 via which the seal is held in a circumferential groove 71, which is incorporated on the outer circumference 88 of the tube element 19. The free end 74 of the seal, which is opposite the web 70, rests sealingly on the downwardly slanting outer surface 52 of the end ring 31. It is therefore ensured that the coupling point KS is always sealed off from the ambient air, even if a relative movement between the end ring 31 and the tube element 19 occurs. It is therefore also possible to compensate for tolerances between the end ring 31 and the tube element 19.

Two coaxially opposed bolts 76 are installed on the tube element 19 in order to hold the tube element in the coupling position which is illustrated in FIG. 2, wherein the bolts are held in a further retaining section 78 of a further receiving slot 77, which is open on one side, by two clamping elements 11 which are fastened on the shaft 59 at a distance a from one another. The retaining section 78 has a greater inner diameter than the smallest inner diameter of the receiving slot 77, which is directly adjacent to the retaining section. In order to improve insertion into the respective receiving slot 77, these receiving slots are provided with insertion surfaces which extend in a diverging manner in the direction of the opening. That is, the inner diameter of the receiving slot 77 increases in the direction of the insertion opening. Due to the elastic material that was selected for the clamping elements 11, the retaining web 79 which extends adjacent to the receiving slot 77 can elastically deflect when the bolts 76 move into the retaining sections 78 until the bolts are located in the respective retaining section 78. The bolts are fixed in this position by means of the elastic springback of the retaining webs 79.

The receiving slots 50 and 77 of the respective clamping element 11 are disposed such that the longitudinal axes thereof, LA and LB, respectively, which extend in the longitudinal planes of the receiving slots, intersect at an angle c of between 60° and 120°.

In order to ensure that the tube element 19 for the connection to the suction tube 16 remains within a predetermined position range on the clamping element 11, it is proposed that the respective clamping element has—as seen in the extension of the second receiving slot 77—a pocket-shaped receptacle 83, which is open on one side and is provided for fixing a web 89 that is fastened on the tube element 19. The positioning of the tube element 19 relative to the clamping element 11, and therefore relative to the suction channel SK of the carrier 20 of the compaction module VM, is thereby ensured.

As illustrated schematically in FIG. 3, the web 89 of the tube element 19 is formed such that, in the installed position (FIG. 2) of the tube element 19, the web protrudes into a pocket-shaped recess 83 of each of two clamping elements 11 that are fastened on the shaft 59 at a distance a, and is fixed therein.

In order to adjust the suction power in accordance with the length of the spinning machine, tube elements 19 can be used that have a different inner diameter L2 of the through-opening 37. It is thereby ensured that approximately the same vacuum conditions exist on all compaction modules VM. The different tube elements can have different colors in order to prevent mix-ups. The use of the tube element that is installed between the suction channel SK of the compaction module VM and the suction tube 16 makes it possible to easily adapt the suction power of the compaction station to the location of the vacuum source SP.

Modifications and variations can be made to the embodiments illustrated or described herein without departing from the scope and spirit of the invention as set forth in the appended claims.

The invention claimed is:

1. A fastening mechanism that detachably fastens and positions a compaction module on a drafting unit of a spinning machine, wherein the compaction module has a carrier with at least one suction channel that is connected to suction inserts of compaction elements movably mounted on the carrier, the fastening mechanism comprising:

two clamping elements that are fastened spaced apart from one another on the spinning machine by retaining members; and each clamping element comprising a first receiving slot that is open on one side and has a retaining section by means of which a retaining element that is fastened on the carrier engages and forms a positive-fitting clamped connection with the clamping element; and wherein each retaining member has a U-shaped opening defined by the clamping element for receipt of a component of the spinning machine, and the first receiving slot is oriented parallel to the U-shaped opening.

2. A fastening mechanism that detachably fastens and positions a compaction module on a drafting unit of a spinning machine, wherein the compaction module has a carrier with at least one suction channel that is connected to suction inserts of compaction elements movably mounted on the carrier, the fastening mechanism comprising:

two clamping elements that are fastened spaced apart from one another on the spinning machine by retaining members;

each clamping element comprising a first receiving slot that is open on one side and has a retaining section by means of which a retaining element that is fastened on the carrier engages and forms a positive-fitting clamped connection with the clamping element; and wherein the positive-fitting connection allows a pivot movement of the carrier in a pivot plane that extends parallel to opposing planes in which the receiving slots of the clamping elements lie, wherein each respective clamping element comprises a stop that limits the pivot movement.

3. The fastening mechanism according to claim 1, wherein each clamping element further comprises a second receiving slot that is open on one side and has a retaining section that forms a positive-fitting connection to a retaining element of a tube element.

4. A fastening mechanism that detachably fastens and positions a compaction module on a drafting unit of a spinning machine, wherein the compaction module has a carrier with at least one suction channel that is connected to suction inserts of compaction elements movably mounted on the carrier, the fastening mechanism comprising:

two clamping elements that are fastened spaced apart from one another on the spinning machine by retaining members;

each clamping element comprising a first receiving slot that is open on one side and has a retaining section by means of which a retaining element that is fastened on the carrier engages and forms a positive-fitting clamped connection with the clamping element;

wherein each clamping element further comprises a second receiving slot that is pen on one side and has a retaining section that forms a positive-fitting connection to a retaining element of a tube element; and wherein a longitudinal axis of the first receiving slot intersects a longitudinal axis of the second receiving slot at an angle (c) on each clamping element.

5. The fastening mechanism according to claim 3, wherein each clamping element further comprises a pocket-shaped receptacle that is open on one side and configured to fix a web fastened on the tube element.

6. A fastening mechanism that detachably fastens and positions a compaction module on a drafting unit of a spinning machine, wherein the compaction module has a carrier with at least one suction channel that is connected to suction inserts of compaction elements movably mounted on the carrier, the fastening mechanism comprising:

two clamping elements that are fastened spaced apart from one another on the spinning machine by retaining members;

each clamping element comprising a first receiving slot that is open on one side and has a retaining section by means of which a retaining element that is fastened on the carrier engages and forms a positive-fitting clamped connection with the clamping element;

wherein each clamping element further comprises a second receiving slot that is open on one side and has a retaining section that forms a positive-fitting connection to a retaining element of a tube element; and wherein the retaining member of the respective clamping elements are formed by a U-shaped base section attached below the first receiving slot.

7. The fastening mechanism according to claim 6, wherein the U-shaped base section comprises limbs that have an opening for receipt of a fixing element.

8. A coupling device for connecting a suction channel integrated in a carrier of a compaction module on a drafting unit of a spinning machine to a suction tube that is connected to a central suction channel, comprising:

a fastening mechanism, the fastening mechanism further comprising two clamping elements that are fastened spaced apart from one another on the spinning machine by retaining members; and each clamping element comprising a first receiving slot that is open on one side and has a retaining section by means of which a retaining element that is fastened on the carrier engages and forms a positive-fitting clamped connection with the clamping element; and a second receiving slot that is open on one side and has a retaining section that forms a positive-fitting connection to a retaining element of a tubular element;

an end ring attached on an end of the suction channel and located in a region of the fastening mechanism, the end ring projecting over the suction channel in a longitudinal direction and having an annular outer surface that extends conically inward and is directed away from the suction channel;

wherein a conically outwardly extending annular inner surface of the tubular element rests on the conically inward annular outer surface of the end ring; and wherein the suction tube sealingly rests with an inner surface thereof on an outer circumference of a free end of the tubular element.

9. The coupling device according to claim 8, wherein the conically extending outer surface of the end ring has an arched curvature where the outer surface rests on the conically extending inner surface of the tubular element.

10. The coupling device according to claim 8, wherein the outer circumference of the tubular element on which the suction tube sealingly rests is provided with a helically extending elevation.

11. The coupling device according to claim 8, further comprising an annular elastic sealing element on the outer circumference of the tubular element that extends across a region of the conically outwardly extending annular inner surface of the tubular element, the sealing element projecting above the tubular element and sealingly resting on the conically inwardly extending annular outer surface of the end ring.

12. The coupling device according to claim 8, wherein the clamping elements are fastened on a shaft that is installed in a longitudinal direction of the spinning machine.

13. The coupling device according to claim 12, wherein the retaining members of the respective clamping elements are formed by a U-shaped base section attached below the first receiving slot, and wherein the shaft is provided with through-openings through which fixing elements protrude into openings of limbs of the U-shaped base section to fasten the clamping elements.

14. The coupling device according to claim 13, wherein the opening of one of the two limbs is provided with a thread, and the fixing element is a screw with a threaded end that extends beyond the shaft.

* * * * *